United States Patent [19]

Nunno

[11] 4,380,329

[45] Apr. 19, 1983

[54] FOOTING JIG FOR POSITIONING FASTENERS

[76] Inventor: Louis E. M. Nunno, P.O. Box 1785, Paso Robles, Calif. 93446

[21] Appl. No.: 180,628

[22] Filed: Aug. 25, 1980

[51] Int. Cl.[3] ..... B25B 1/20

[52] U.S. Cl. ..... 269/41; 269/287; 269/904

[58] Field of Search ..... 269/41, 287, 904; 248/125, 56, 27.3; 403/194, 197; 52/749

[56] References Cited

U.S. PATENT DOCUMENTS

| | | | |
|---|---|---|---|
| 3,167,292 | 1/1965 | Meyerowitz | 248/56 |
| 3,552,734 | 1/1971 | Severino | 269/904 |
| 4,061,322 | 12/1977 | Le Blanc | 269/904 |

*Primary Examiner*—Robert C. Watson

*Attorney, Agent, or Firm*—Lyon & Lyon

[57] ABSTRACT

A device for the establishment of the proper location for the footings of a structure and a device for the proper placement of mounting bolts within a footing. The device is adjustable and can be set to varying heights to insure that all footings for the structure are of equal height, thereby providing a level foundation for the structure.

6 Claims, 5 Drawing Figures

FOOTING JIG FOR POSITIONING FASTENERS

BACKGROUND

This invention relates to structures, more particularly to a method for determining the location of the various footings plus an apparatus for the placement of fasteners within the footing.

There has been a tremendous growth in the number of small aircraft now in use throughout the world. The cost of these aircraft has risen dramatically and now represents a considerable capital investment on the part of the aircraft owner. These is a need, therefore, for an economical means of protecting these aircraft from damage due to either the natural elements, vandalism or theft. Hangar facilities at most airports are limited in available space and also quite expensive As a result most small, privately-owned aircraft are tied down in the open on airport aprons where they are highly vulnerable to damage or theft.

The need, therefore, exists for a low-cost, easily constructed hangar for a single aircraft. The desirability of using a prefabricated structure is apparent as a means for satisfying the need for such a low cost, easily constructed hangar. By utilizing a procedure wherein all the members of the hangar are fabricated at a central workshop and shipped to the construction site already cut into the proper lengths ready to be put together, the cost of the hangar may be greatly reduced. This method of construction, however, requires that the holes in the structural members, through which the bolts are inserted, be pre-drilled. This requirement in turn necessitates that the fasteners set within the footing, to which the connecting members are bolted, be located with precise accuracy. Prior attempts to fulfill this need, however, have necessitated the employment of a surveyor, usually at a considerable expense, to lay out a foundation plan of the structure and the grading plan for the surface upon which the structure is to be constructed. This invention eliminates the costly necessity of employing a surveyor for the plotting of the foundation plan for the structure.

Furthermore, the construction of the standard footing has required considerable time and effort in the placement of the fasteners within the footing. The prior methods of setting such fasteners within a footing have failed to provide the accuracy required. Therefore, a need exists for a simple mechanical device that can be utilized to set the fasteners within a footing on a uniform and consistent basis, thereby allowing the use of pre-cut and pre-drilled connecting members to be placed between the footings.

SUMMARY OF INVENTION

The method and device of the present invention overcomes the problems of locating the footings and placing the fasteners within the footings with a desired degree of accuracy. This invention comprises a method for plotting the location of the central points of the footings for a structure, which can be, for example, an aircraft hangar whereby a reference line is laid out with reference points marked off on said line. These reference points may in fact also represent the center point of footings for the structure. Varying arcs of predetermined length are then struck from the reference points located on the center line. The points of intersection of the various arcs locate the center points for the remaining footings of the structure.

Additionally, the invention comprises a footing jig which is utilized to place the mounting bolts or other suitable fasteners within the footing and fix the elevation of the top of the footing. The footing jig is used in connection with a reinforcement bar that is set at the center point of each of the footings, which can be located by the method described above. The footing jig is fastened to the reinforcement bar and may be set at various elevations thereby allowing the user to set the footing jig at the desired height for any particular footing. The fasteners to be set within the footing may then be attached to the footing jig and held in place for the pouring of the concrete or other suitable mixture within the footing.

Thus, it is the object of this invention to provide a simple and accurate means for plotting the location of the footings for structures.

It is another object of this invention to provide a device which can be used to properly position the fasteners within a footing.

It is still another object of this invention to provide a device which is inexpensive, yet durable and reusable.

An additional object of this invention is to provide a device which allows for adjustment of the depth to which the fasteners are set within the footings.

These and other objects and advantages will be apparent from the following description in conjunction with the drawings.

DETAILED DESCRIPTION

Figure 1:
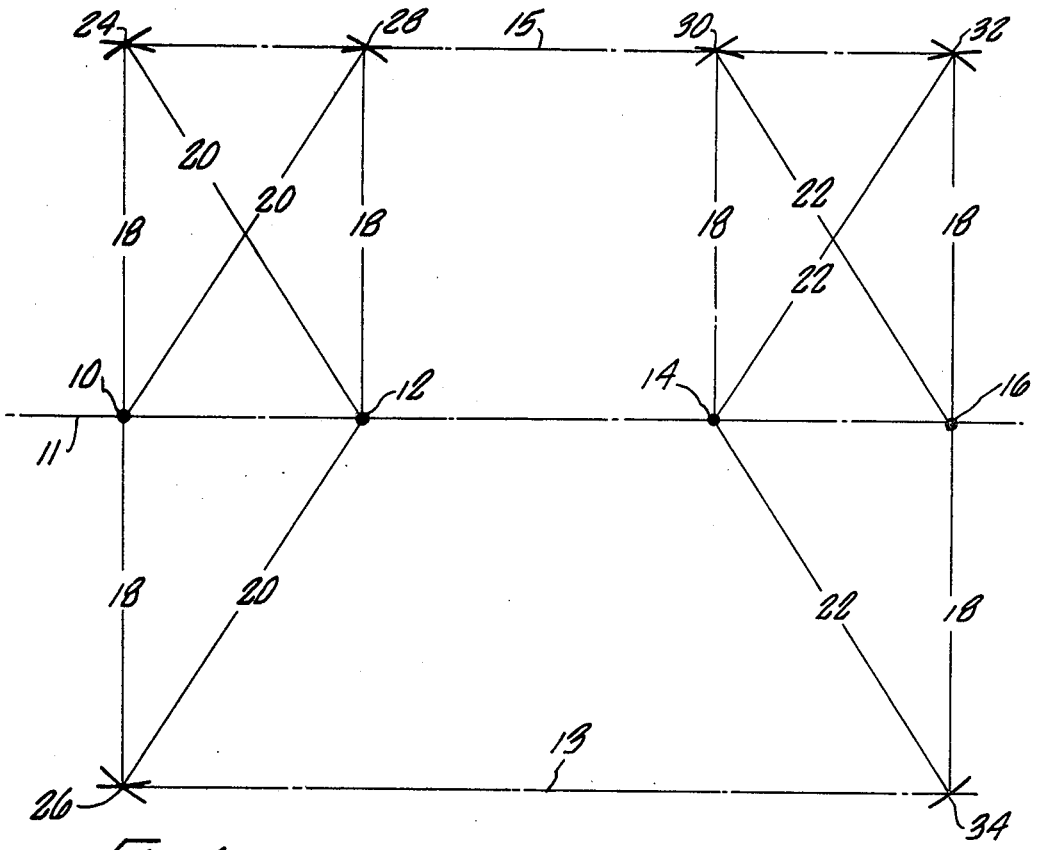
FIG. 1 is a schematic view of the footing plan for a rectangular structure.

With reference now to FIG. 1, a first, second, third and fourth reference point 10, 12, 14 and 16, respectively, are located on a central reference line 11 of the structure. The distances between these reference points are determined by the specifications of the structure to be constructed. The builder of the structure lays out the reference line 11 and measures off and marks the location of the reference points on said reference line 11. Depending upon the nature of the structure being constructed, these reference points may also constitute the center points of footings for the structure.

An arc 18 having a radius equal in length to the distance, measured perpendicularly from the reference line 11, which the footing sought to be located is to be set from the reference point, according to the specifications of the structure, is struck from the first reference point 10. An arc 20 having a radius equal in length to the square root of the sum of the radius of arc 18 squared and the distance between reference points 10 and 12 squared is now struck from the second reference point 12. The points of intersection of these two arcs constitute the center points of two footings for the structure, with one footing 26 being located on a front line 13, a line running between footings 26 and 34 as shown in FIG. 1, of the structure, and a footing 24 located on a back line 15, a line running between footings 24 and 32 as shown in FIG. 1, of the structure. The procedure is now reversed and an arc 18 is struck from the second reference point 12 with a radius equal in length to the arc previously rotated from the first reference point 10. An arc 20 is also struck from the first reference point 10 having a radius equal in length to the arc previously struck from the second reference point 12. The intersection of these arcs locates the center point of an additional footing 28 located on the back line 15 of the structure. In the instant embodiment, a footing center point is not placed at the point of the intersection of these arcs on the previously described front line 13 of the structure, thereby leaving the front of the structure unobstructed which will allow the usage of the structure as an aircraft hangar. A footing may be placed at this point of intersection where the nature of the structure being constructed does not require that one side of said structure be free from all obstructions.

The procedure described above is now repeated with the fourth reference point 16 being treated the same as the first reference point 10 in the above-described procedure, while the third reference point 14 is treated the same as the second reference point 12 in the above-described procedure. An arc 18 having a radius equal in length to the radius of the arc 18 originally struck from the first reference point in the above-described procedure is now struck from the fourth reference point 16. An arc 22 having a radius equal in length to the square root of the sum of the length of arc 18 squared and the square of the distance between the third and fourth reference point 14 and 16, respectively, is now struck from the third reference point 14. The intersection of these arcs locates the center points for two additional footings for the structure, one footing 34 located on the front line 13 of the structure while the second footing 32 is located on the back line 13 of the structure. An arc 18 having a radius equal in length to the arc previously struck from the fourth reference point 16 is now struck from the third reference point 14. An arc 22 having a radius equal in length to the arc previously struck from the third reference point 14 is now struck from the fourth reference point 16. The intersection of these two arcs locates the center point for an additional footing 30 for the structure. As discussed above in this embodiment of the invention a footing is not placed at the intersection of these points on the front line 13 of the structure.

The procedure described above represents a method for determining the location of the footing of a structure having a rectangular configuration, without any interior footings located on the front line 13 of the structure. This configuration allows for the usage of the structure as an airplane hangar. It should be noted that depending upon the nature of the structure to be constructed the builder may desire to place footings at all or some of the reference points 10, 12, 14, and 16 located on the reference line 11 of the structure.

Figure 2:
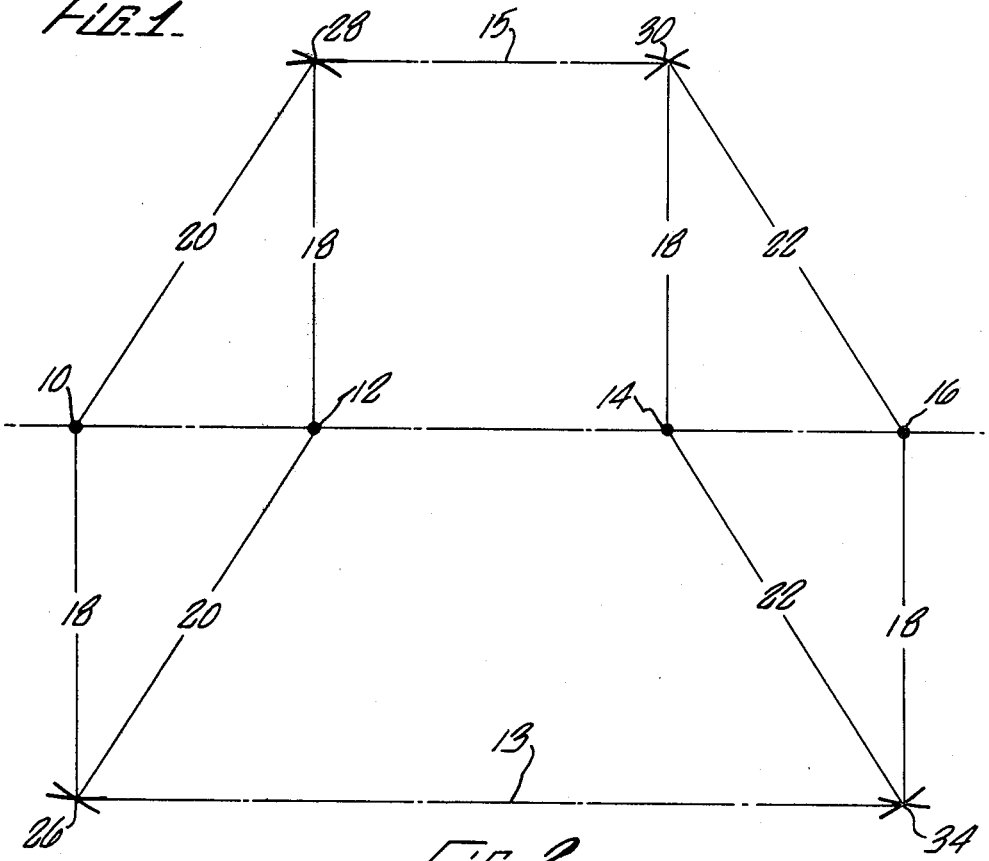
FIG. 2 is a schematic view of a footing plan for a T-shaped structure.

The method described above is not limited to locating the footings for a structure having a rectangular configuration. A second embodiment of the invention as shown in FIG. 2 involves a structure designed in a T-shape. As described in the first embodiment, a reference line 11 is laid out containing four reference points 10, 12, 14, and 16, respectively, with the distances between the reference points being determined according the nature and specifications of the structure to be constructed. The previously described method is employed resulting in the location of the center points of footings 26, 28, 30 and 34. In this embodiment the reference points located on the reference line 11 are also utilized as the center points for footings 10, 12, 14 and 16. This embodiment provides a structure having a configuration similar to that of an airplane.

Figure 3:
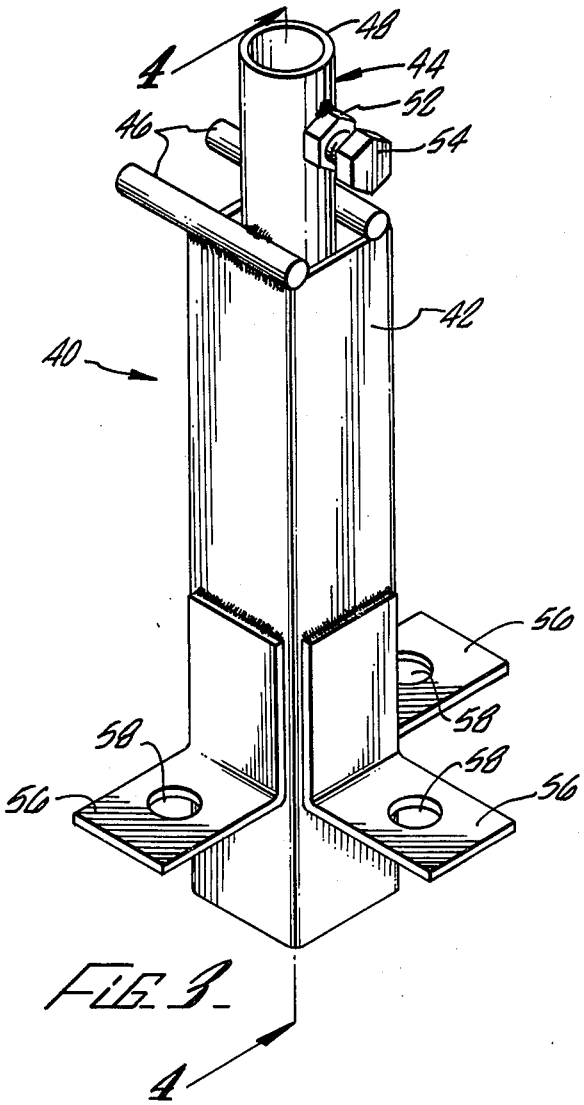
FIG. 3 is a perspective view of the footing jig.

Turning now to FIG. 3, an exemplary footing jig 40 in accordance with the present invention is utilized for the proper placement of the fasteners within the footings previously located by employing the method described above. The type of footing which the preferred embodiment of this invention is used in conjunction with is constructed by pouring a liquid mixture, for example, concrete, into a form which may be constructed out of various materials such as wood or metal or may in fact be poured simply into a hole in the ground. Upon a hardening of the liquid the support elements of the structure are placed upon the footings and are attached thereto. A common method for attaching these support members to the footings is the placement of fasteners within the footing prior to the pouring of the liquid. Upon the hardening of the liquid the fasteners are securely set within the footing and the support members of the structure may then be securely attached to the footing. This invention provides for the proper placement of these fasteners within the footings. The body of the footing jig 40 is comprised of a hollow central member 42 which in the preferred embodiment is rectangular in shape and can be constructed out of steel tubing, to which an alignment member 44 is attached by means of two rods 46 which position the alignment member 44 at the center of the central member 42. The alignment member 44 is comprised of a hollow cylindrical sleeve 48 having a hole 50 in the wall of the sleeve. A threaded nut 52 is fixed to the outside of the sleeve with the opening of the nut aligned with the hole 50 in the sleeve 48. A locking bolt 54 is screwed into the nut 52. Support members, which may be angle iron 56, are fastened to the sides of the central member 42. In the described embodiment the angle irons are attached to a plurality of the sides of the rectangular central member 42. The angle irons 56 are attached at identical locations upon the sides of the central member 42 to insure uniform placement of the fasteners within the footing. The angle irons 56 are attached to the central member 42 such that one leg of the angle iron 56 runs parallel to the longitudinal center line of the footing jig 40 and the second leg of the angle iron 56 extends horizontally at a 90 degree angle from the longitudinal center line of the footing jig 40. Each angle iron 56 has a hole 58 located in the center of the horizontal leg of the angle.

Figure 4:
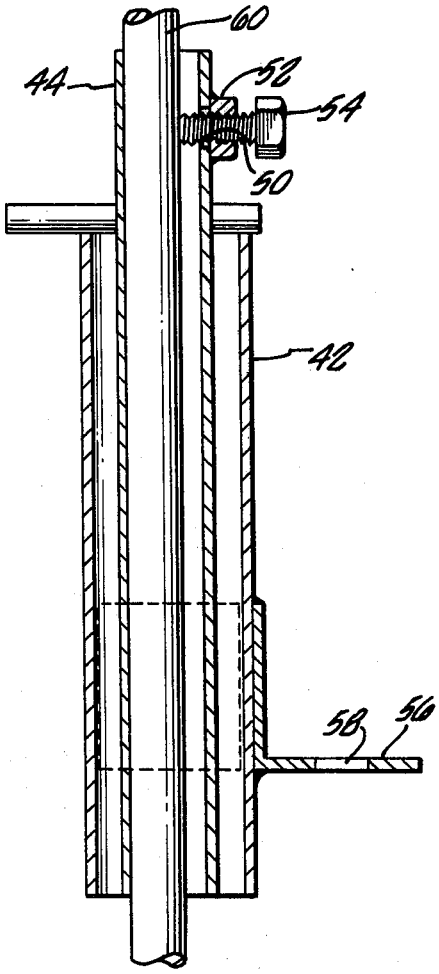
FIG. 4 is a longitudinal cross-sectional view of the footing jig taken along line 4—4 of FIG. 3.
Figure 5:
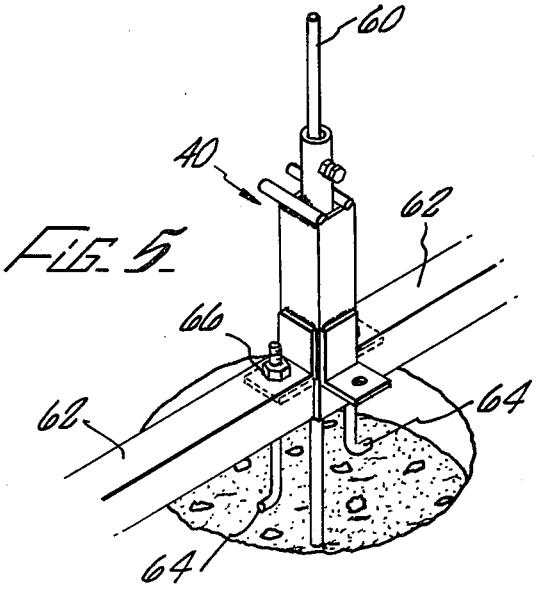
FIG. 5 is a perspective view of the footing jig showing the invention as actually used.

The footing jig 40 is utilized by first setting a reinforcement bar 60 at the center point, as located by the above-described method, of each of the footings of the structure. The footing jig 40 is then placed over the reinforcement bar 60 with the bar passing through the cylindrical sleeve 48 of the alignment member 44. The footing jig 40 is then moved along the reinforcement bar 60 until the horizontal legs of the angle irons 56 are at an elevation equal to the height of the top of the horizontal support elements 62 of the structure when placed upon the footings. Once the footing jig 40 has been moved to this elevation the locking bolt 54 is tightened down onto the reinforcement bar 60 thereby locking the footing jig 40 in place as illustrated in FIG. 4. A footing jig is then placed at each of the footings of the structure. In actual use one or more support elements 62 are attached to the footing jig 40 as illustrated in FIG. 5. The support elements 62 are inserted over and rest upon the horizontal leg of the angle iron 56. The support members 62 have pre-drilled holes in both the top and bottom sides of the members which align with the holes 58 in the angle iron 56. The fasteners, which as illustrated in FIG. 5 may be J bolts, are then inserted through the aligned holes of the member 62 and the angle iron 56. A nut 66 is then screwed onto the threaded portion of the J bolt 64. The depth to which the fastener is embedded into the footing may be adjusted by the distance the nut 66 is threaded down onto the fastener 64. The footing jig 40 insures that all of the fasteners are placed at the same location with respect to the reinforcement bar 60 in each footing. This enables the builder to use pre-cut and pre-drilled material, thereby avoiding the costly and time-consuming process of having to customize the members to the differing dimensions of each structure. The attaching of the support element 62 between the footing jigs prior to the pouring of the footing insures that the fasteners located in each of the individual footings are properly located in relationship to the fasteners in the adjacent footings. Thus, while the footing jig 40 insures that the fasteners are located at the proper distances and locations from the reference point of the footings at which the reinforcement bar 6 is placed, the placement of the support elements 62 between the footings prior to the pouring of the footings insures that the fasteners 64 are properly set not only with regards to the center point of each individual footing but with regards to the fasteners in the adjacent footings. This system of using the footing jigs 40 in conjunction with the support elements 62 insures that all of the fasteners within all of the footings of the structure are properly positioned, thereby enabling the use of pre-cut and pre-drilled members of the structure. The use of the structural element 62 also enables the builder to determine the exact height of each of the footings since the bottom plane of the support element 62 rests upon the top surface of the footings.

It should be noted that FIG. 5 demonstrates the footing jig 40 having three angle irons 56 attached to three of the four sides of the rectangular central member 42. Furthermore, the FIG. 5 shows the support elements 62 attached to two of the three angle irons 56. The illustration in FIG. 5 is not intended to serve as a limitation upon the scope of this invention. It is apparent that other embodiments of this invention would utilize the third angle iron 56 as shown in FIG. 5 and may in fact utilize a fourth angle iron attached to the remaining side of the central member 42, depending upon the nature of the structure being constructed. Furthermore, depending upon the nature of the structure being constructed and the desired positioning of the footings, other embodiments of the invention are readily conceivable wherein the central member 42 is cylindrical in shape, triangle in shape, or is one of many other shapes which might be called for due to the nature of the structure being constructed and that structure's unique footing plan.

Having thus described one embodiment of my invention in detail, it is to be understood that numerous equivalents and alterations which do not depart from the invention will be apparent to those skilled in the art, given the teaching herein. Thus, my invention is not to be limited to the above description, but is to be of the full scope of the appended claims.

What is claimed:

1. A system for the placement of the footing fasteners within a given footing of a structure in the proper location with respect ot the footing fasteners in adjacent footings of said structure wherein said structure includes a support element extending between the footing fasteners of adjacent footings, comprising:

a first device for positioning footing fasteners, with said device including a body having an elongated opening therethrough for receiving a reference member, said body including locking means for locking said device to said reference member at a predetermined position, and a plurality of support members fixed to said body, each said support member having an opening for receiving and thereby positioning a respective fastener, wherein the support members are designed to receive a first end of a support element of the structure, and a second device for positioning footing fasteners, with said device including a body having an elongated opening therethrough for receiving a reference member, said body including locking means for locking said device to said reference member at a predetermind position, and a plurality of support members fixed to said central member, each said support member having an opening for receiving and thereby positioning a respective fastener, wherein the support members are designed to receive the second end of a support element of the structure, thereby aligning said footing fasteners with respect to the support element and the adjacent footing.

2. A system as in claim 1 wherein said body members each comprise:

an alignment member which includes said elongated opening and a central member fixed to said alignment member and supporting said support members.

3. A system as in claim 2 wherein said devices include an alignment member comprised of:

a cylindrical sleeve, said sleeve being attached to the central member in such a manner that the longitudinal axis of the cylindrical sleeve is aligned with the longitudinal axis of said central member.

4. A system as in claim 3 wherein the central member of said devices is a rectangular tube.

5. A system as in claim 4 wherein the support members of said devices are fixed to the central member in such a manner that the central axis of the opening in said support members is parallel with the longitudinal axis of said central member.

6. A device for positioning footing fasteners with respect to a reference member of the footings comprising:

an alignment member having an elongated opening therethrough for receiving said reference member and a rectangular tube fixed to said alignment member, said alignment member including locking means for locking said device to said reference member at a predetermined position; and a plurality of support members, fixed to said rectangular tube, each said support member having an opening for receiving and thereby positioning a respective fastener.

* * * * *